United States Patent [19]

Ariga et al.

[11] Patent Number: 4,984,554

[45] Date of Patent: Jan. 15, 1991

[54] AUTOMATIC AIR BLEEDING DEVICE FOR FUEL FEED SYSTEM OF DIESEL ENGINE

[75] Inventors: Masahiro Ariga; Saburou Takise; Aturo Fujii, all of Hino, Japan

[73] Assignee: Hino Judosha Kogyo Kabushiki Kaisha, Tokyo, Japan

[21] Appl. No.: 410,406

[22] Filed: Sep. 21, 1989

[30] Foreign Application Priority Data

| | | | |
|---|---|---|---|
| Oct. 17, 1988 | [JP] | Japan | 63-261229 |
| Nov. 8, 1988 | [JP] | Japan | 63-281650 |
| Nov. 21, 1988 | [JP] | Japan | 63-294368 |

[51] Int. Cl.[5] ..... F02M 39/00

[52] U.S. Cl. ..... 123/516; 123/679 L; 123/514

[58] Field of Search ..... 123/516, 179 L, 510, 123/514

[56] References Cited

U.S. PATENT DOCUMENTS

| | | | |
|---|---|---|---|
| 2,414,158 | 1/1947 | Mock | 123/516 |
| 2,878,889 | 3/1959 | Gilbert | 123/516 |
| 4,296,723 | 10/1981 | Aldrich | 123/514 |
| 4,346,682 | 8/1982 | Bauder | 123/516 |
| 4,370,967 | 2/1983 | Gmelin | 123/516 |
| 4,450,820 | 5/1984 | Haines | 123/516 |
| 4,570,604 | 2/1986 | Thornton | 123/514 |
| 4,625,694 | 12/1986 | Adey | 123/516 |
| 4,726,335 | 2/1988 | Brauninger | 123/179 L |
| 4,807,583 | 2/1989 | Thornthwhite | 123/516 |

FOREIGN PATENT DOCUMENTS

| | | | |
|---|---|---|---|
| 887934 | 11/1943 | France | 123/516 |
| 0200663 | 12/1982 | Japan | 123/516 |
| 0048768 | 3/1983 | Japan | 123/516 |

*Primary Examiner*—Carl Stuart Miller

*Attorney, Agent, or Firm*—Scrivener and Clarke

[57] ABSTRACT

A check valve is disposed in a suction-side line of a feed pump in a fuel feed system and permits the fuel to direct only toward a feed pump; a bypass line is provided for bypassing the check valve; and a pump is disposed in the bypass line. Alternatively, a line is branched from the suction side line of the feed pump in the fuel feed system and is communicated with a gallery chamber within the feed pump; a check valve is disposed in the branched line to direct the fuel only flowing toward the gallery chamber line; and a pump is disposed in the branched line upstream of the check valve. As a result, when air intermixes in the fuel feed system, the pump is energized prior to starting the engine to force the fuel having the air bubbles entrained therein though the feed pump into a fuel tank, thereby accomplishing air bleeding operation.

2 Claims, 4 Drawing Sheets

AUTOMATIC AIR BLEEDING DEVICE FOR FUEL FEED SYSTEM OF DIESEL ENGINE

BACKGROUND OF THE INVENTION

The present invention relates to an automatic air bleeding device for a fuel feed system of a diesel engine.

In general, as shown in FIG. 1, a fuel feed system of a diesel engine comprises a fuel tank 1, a water separator 2, a feed pump 3, a fuel filter 4, an injection pump 5 and an injection nozzle 6.

During the operation after the starting of the engine, the fuel in the fuel tank 1 is sucked by the feed pump 3 to be fed through the water separator 2 for separation of water contained in the fuel into a gallery chamber 3*a* which has a plunger and springs (not shown) and which is disposed within the feed pump 3 and is filtered by the fuel filter 4 to flow into the injection pump 5 where the fuel is forced to pass to the injection nozzle 6 which is connected to a cylinder head (not shown) so that the fuel is injected under controlled pressure into a combustion chamber (not shown).

The injection pump 5 is provided with an overflow valve 8 which is adapted to control the pressure of the fuel to be fed to the injection pump 5 at a predetermined pressure. More specifically, when the pressure of the fuel is in excess of a predetermined level, the overflow valve 8 is opened to return the fuel through the overflow pipe 9 into the fuel tank 1.

Reference numeral 10 represents a leakage pipe for returning to the fuel tank 1 the fuel which has lubricated a nozzle needle of the injection nozzle 6.

With the diesel engine having the fuel feed system of the type described above, when air intermixes in the fuel feed system due to emptiness of the fuel tank, replacement of the fuel filter 4 or the like, the fuel supply from the feed pump 3 to the injection pump 5 is not stabilized and the engine starting failure occurs. Therefore when the fuel feed system contains the air, before starting of the engine an air bleeding plug 11 is loosened and a driver operates a manually operated priming pump 12 until fuel free from air bubbles begins to flow through the air bleeding plug 11. Such manual operation casts a cumbersome burden to a driver.

In view of the above, the present invention has its object to provide an automatic air bleeding device for a fuel feed system of a diesel engine which can considerably relieve a driver's burden in air bleeding operation.

The above and other objects, effects, features and advantages of the present invention will become more apparent from preferred embodiments thereof taken in conjunction with the accompanying drawings.

BRIEF DESCRIPTION OF THE DRAWINGS

The same reference numerals are used to designate similar parts throughout the figures.

DETAILED DESCRIPTION OF THE PREFERRED EMBODIMENTS

Figure 1:
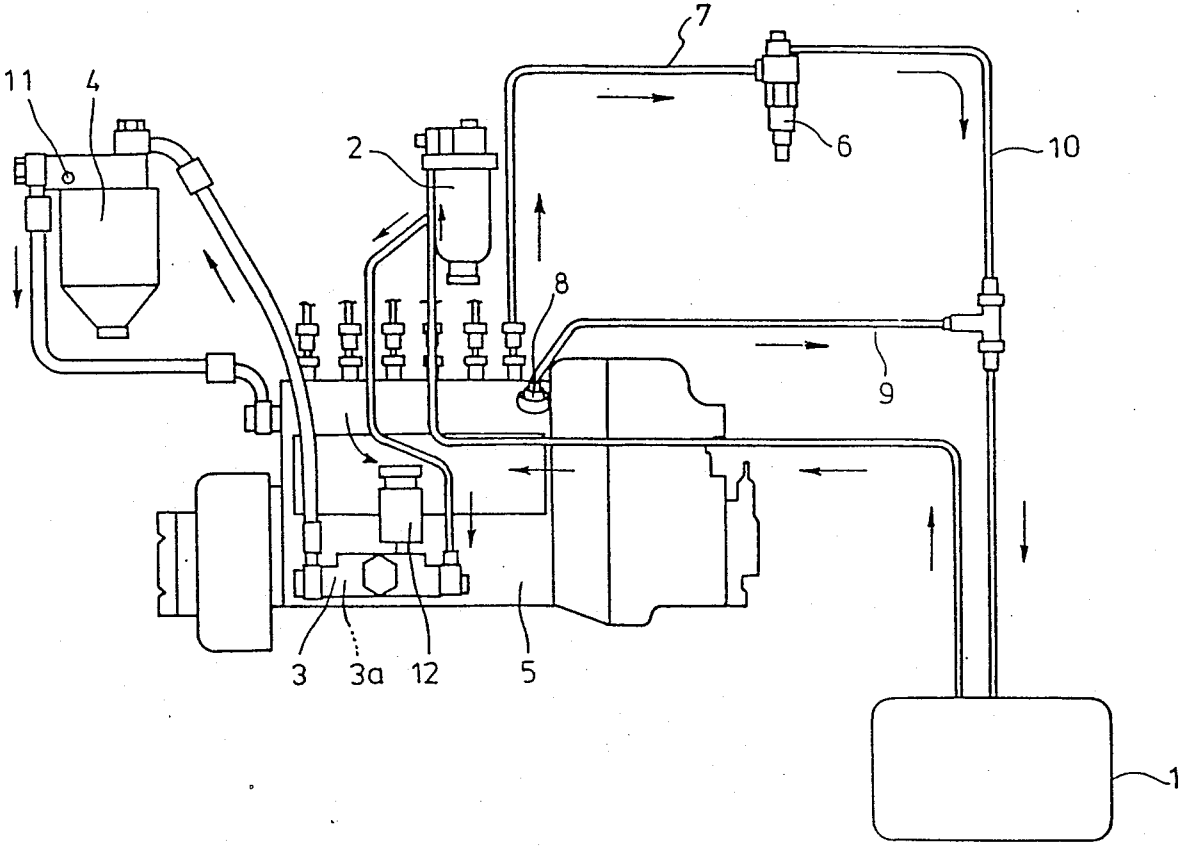
Fig. 1 PRIOR ART
FIG. 1 is a view used to explain a conventional fuel feed system.
Figure 2:
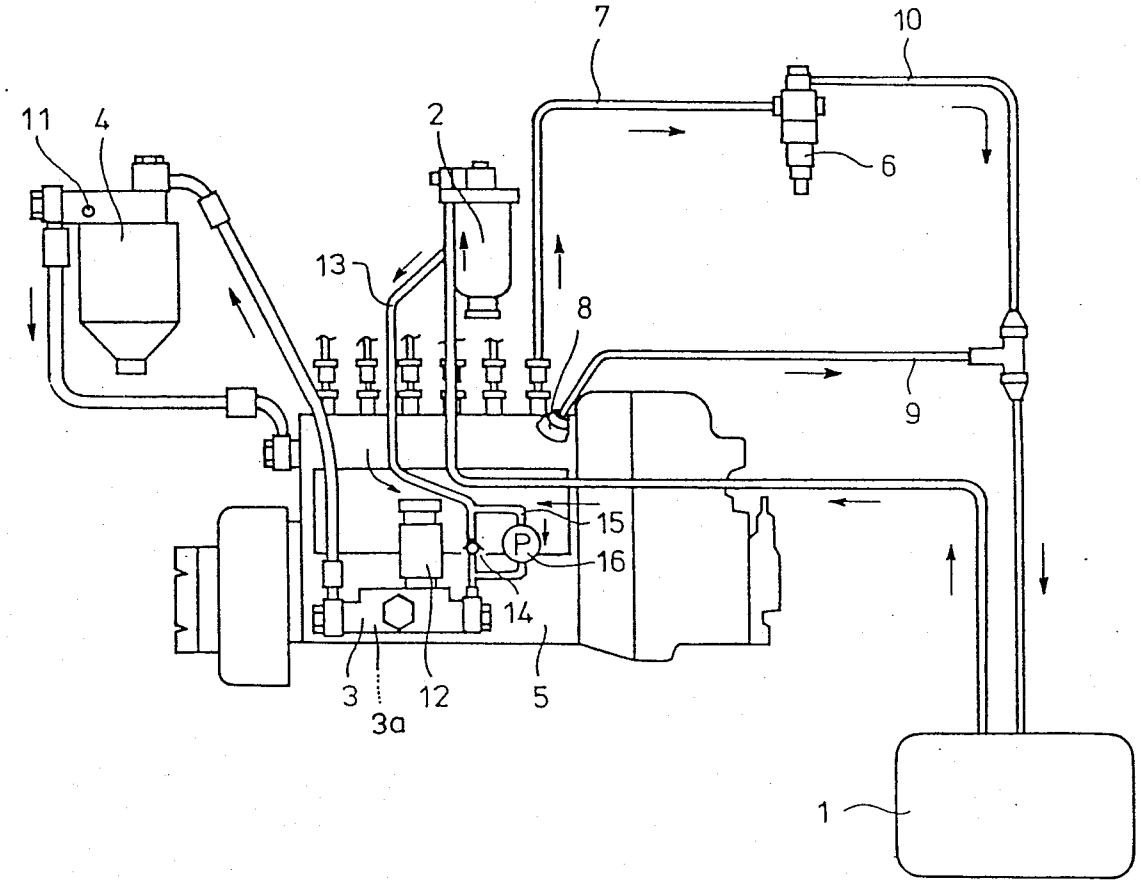
FIGS. 2, 3 and 4 are views illustrating respectively first, second and third preferred embodiments of the present invention.

Referring particularly to FIG. 2, a first preferred embodiment of the present invention will be described in which a suction-side line 13 of the feed pump 3 is provided with a check valve 14 which only permits the flow of the fuel from the water separator 2 to the feed pump 3 and a bypass line 15 is disposed for bypassing the check valve 14. The bypass line 15 has a solenoid controlled pump 16 which is selectively energized and de-energized separately from the diesel engine by ON-OFF operation of a switch (not shown). It is to be understood that instead of the solenoid controlled pump 16, a motor operated pump, a trochoid pump or the like may be used.

Next the mode of operation will be described. When air has intermixed in the fuel feed system due to emptiness of the fuel tank, replacement of the air filter or the like, before the starting of the engine the switch (not shown) is turned on to energize the solenoid controlled pump 16 so that because of actions of the pump 16 and of the check valve 14, the fuel is forced to flow from the line 13 through the bypass line 15 into the gallery chamber 3*a* in the feed pump 3. Thereafter the fuel is fed through the fuel filter 4 into the injection pump 5. Discharge pressure of the fuel from the solenoid controlled pump 16 causes the overflow valve 8 to open so that the fuel is returned from the overflow pipe 9 to the fuel tank 1. The air bubbles entrained in the fuel is also forced to flow into the fuel tank 1 and is removed out of the fuel feed system.

After the solenoid controlled pump 16 has been energized for about 30 seconds to complete the air bleeding, the switch (not shown) for the pump 16 is turned off and the engine is started. The fuel is sucked from the fuel tank by the feed pump 3, passes through the water separator 2 and the check valve 14 without passing through the bypass line 15, the gallery chamber 3*a* disposed within the feed pump 3 and the fuel filter 4 to the injection pump 5. The fuel is sprayed by the injection nozzle 6 into the combustion chamber, whereby the stable operation of the engine can be started with no engine starting failure.

Figure 3:
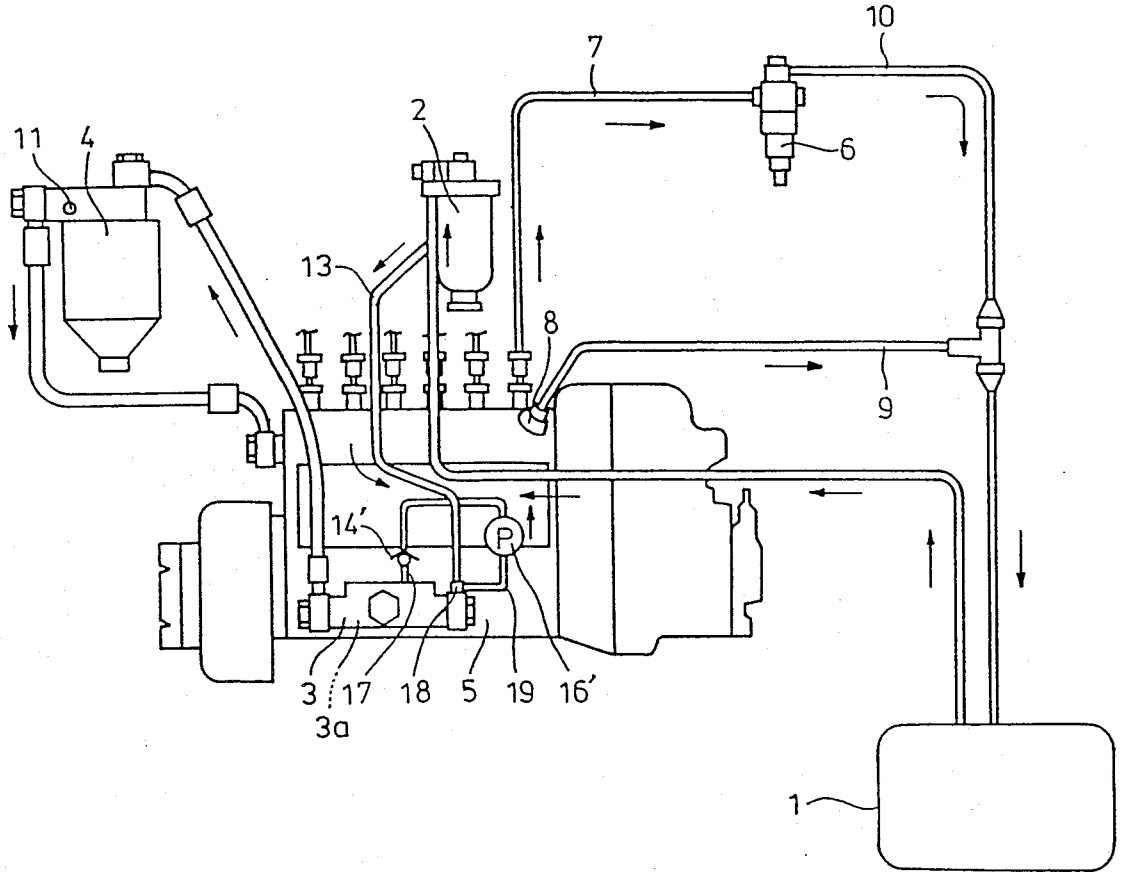

Referring next to FIG. 3, a second preferred embodiment of the present invention will be described. Instead of the priming pump 12 mounted on the feed pump 3 and in communication with a port 17 leading to the gallery chamber 3*a*, a check valve 14' is communicated at its discharge side with the port 17. The feed pump 3 has at its inlet side a joint 18 which is communicated with an inlet side of the check valve 14' through a branched line 19 which has a solenoid operated pump 16' adapted to force the fuel to flow from the joint 18 to the check valve 14'. It is to be understood that instead of the solenoid controlled pump 16', a motor operated pump, a trochoid pump or the like may be used.

Next the mode of operation of the fuel feed system with the above-described construction will be described. When air intermixes in the fuel feed system, prior to starting engine a switch (not shown) for the pump 16' is turned on to energize the latter. Then the fuel is forced from the line 13 through the branched line 19, the check valve 14' and the port 17 into the gallery chamber 3*a* within the feed pump 3. And as in the case of the first preferred embodiment described above, the air entrained in the fuel is forced to flow into the fuel tank, whereby the air is removed out of the fuel feed system.

After the air bleeding operation has been completed, the switch (not shown) for the solenoid controlled pump 16' is turned off and the engine is started. The fuel sucked by the feed pump 3 from the fuel tank 1 flows through the water separator 2, the line 13, the gallery 3*a* within the feed pump 3 and the fuel filter 4 to the injection pump 5 so that the fuel is sprayed by the nozzle 6 in the combustion chamber. Therefore, the engine can be started without any failure and the stable operation of the engine can be ensured.

Figure 4:
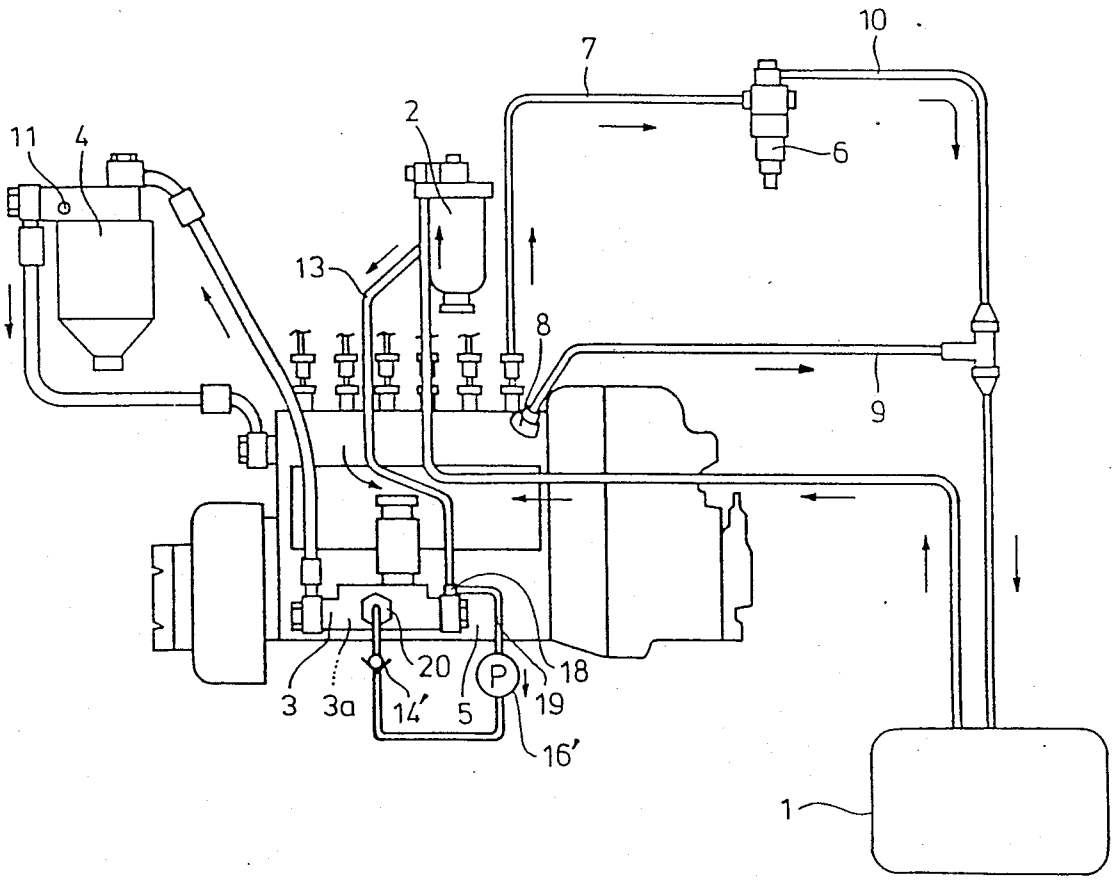

Referring next to FIG. 4, a third embodiment of the present invention will be described. The check valve 14' is attached at its discharge side directly to a cover 20 which also serves as a spring seat of a plunger (not shown) incorporated in the feed pump 3. The joint 18 communicated with the line 13 is connected to an inlet side of the check valve 14' through a branched line 19 which in turn has a solenoid operated pump 16' for forcing the fuel to flow from the joint 18 to the check valve 14'. It is to be understood that instead of the solenoid controlled pump 16', a motor operated pump, a trochoid pump or the like may be employed as in the cases of the first and second embodiments.

Next the mode of operation of the third embodiment with the above-mentioned construction will be described. When air intermixes in the fuel feed system, prior to starting of the engine the switch (not shown) for the pump 16' is turned on. Then the fuel flows from the line 13 through the branched line 19 and the check valve 14' into the gallery chamber 3*a* within the feed pump 3. As a result, the air bubbles entrained in the fuel is forced to flow into the fuel tank 1, whereby the air is removed from the fuel feed system.

After the air bleeding operation has been completed, the switch (not shown) for the pump 16' is turned off and the engine is started. The fuel is sucked from the fuel tank 1 through the water separator 2 and the line 13 and flows through the gallery chamber 3*a* within the feed pump 3, without passing through the branched line 19 because of action of the check valve 14°, and the fuel filter 4 to the injection pump 5 so that the fuel is injected by the injection nozzle 6 into the combustion chamber. Thus the engine can be started with no trouble and the stable operation of the engine can be ensured.

It is to be understood that the present invention is not limited to the three embodiments described above and that various modifications may be effected without leaving the true spirit of the present invention. For instance, the attachment of the check valve 14° is not limited to the port 17 of the priming pump 12 or the cover 20; the valve 14' may be attached to any place which is communicated with the gallery chamber 3*a* within the feed pump 3. Instead of connecting the check valve 14' directly to the feed pump 3, it may be inserted in the branched pipe 19 and downstream of the pump 16'.

As described above, an automatic air bleeding devices for a fuel feed system of a diesel engine in accordance with the present invention, the air bleeding operation can be accomplished in an extremely simple manner and burden on a driver is considerably relieved.

What is claimed is:

1. An automatic air bleeding device for a fuel feed system for supplying fuel to a diesel engine from a fuel supply tank comprising a check valve in a suction side line of a feed pump in the fuel feed system so as to permit fuel to flow only into said feed pump, a bypass line bypassing said check valve and a auxiliary pump in said bypass line selectively operable separately from said diesel engine for forcing aerated fuel through said fuel feed system back to said tank prior to the starting of said diesel engine.

2. An automatic air bleeding device for a fuel feed system for supplying fuel to a diesel engine from a fuel supply tank comprising a line branched from a suction side line of a feed pump in the fuel feed system and in communication with a gallery chamber of the feed pump, a check valve in said branched line for permitting the fuel to flow only into said gallery chamber and an auxiliary pump in said branched line upstream of said check valve and selectively operable separately from said diesel engine for forcing aerated fuel through said fuel feed system back to said tank prior to the starting of said diesel engine.

* * * * *